US010759202B2

(12) United States Patent
Chen et al.

(10) Patent No.: US 10,759,202 B2
(45) Date of Patent: Sep. 1, 2020

(54) RIBBON REWINDING MECHANISM FOR PROVIDING STABLE RIBBON TENSION IN A PRINTER

(71) Applicant: TSC AUTO ID TECHNOLOGY CO., LTD., New Taipei (TW)

(72) Inventors: Yu-Zhi Chen, Yilan County (TW); Zhi-Hao Lu, Yilan County (TW); I-Che Yu, Yilan County (TW); Yan-Zhang Chen, Yilan County (TW)

(73) Assignee: TSC AUTO ID TECHNOLOGY CO., LTD., New Taipei (TW)

( * ) Notice: Subject to any disclaimer, the term of this patent is extended or adjusted under 35 U.S.C. 154(b) by 41 days.

(21) Appl. No.: 16/223,276

(22) Filed: Dec. 18, 2018

(65) Prior Publication Data

US 2019/0232691 A1 Aug. 1, 2019

(30) Foreign Application Priority Data

Jan. 29, 2018 (TW) ..... 107201399 U

(51) Int. Cl.

| | |
|---|---|
| ***B41J 15/16*** | (2006.01) |
| ***B65H 23/18*** | (2006.01) |
| ***B65H 18/10*** | (2006.01) |
| ***B41J 33/40*** | (2006.01) |

(52) U.S. Cl.

CPC ..... *B41J 15/16* (2013.01); *B41J 33/40* (2013.01); *B65H 18/103* (2013.01); *B65H 23/1806* (2013.01)

(58) Field of Classification Search

CPC ..... B41J 15/16; B41J 33/40; B65H 18/103; B65H 23/1806

See application file for complete search history.

(56) References Cited

U.S. PATENT DOCUMENTS

| | | | | |
|---|---|---|---|---|
| 5,769,350 | A * | 6/1998 | Oka | B41J 15/16 242/422.4 |
| 6,315,235 | B1 * | 11/2001 | Breyer | B41J 15/16 242/422.4 |
| 2010/0215421 | A1 | 8/2010 | Tomasik | |
| 2016/0325563 | A1 * | 11/2016 | Kokuta | B41J 11/0045 |
| 2017/0305173 | A1 * | 10/2017 | Onodera | B41J 15/16 |

FOREIGN PATENT DOCUMENTS

| | | |
|---|---|---|
| CN | 2873714 Y | 2/2007 |
| CN | 201353909 Y | 12/2009 |

* cited by examiner

*Primary Examiner* — Sang K Kim

(74) *Attorney, Agent, or Firm* — Li & Cai Intellectual Property (USA) Office

(57) ABSTRACT

A ribbon rewinding mechanism for providing stable ribbon tension in a printer includes a base body, a supply shaft assembly, a take-up shaft assembly and a transmission system. Each of the supply shaft assembly and the take-up shaft assembly has an axis rod, an outer cover and an elastic member. The outer cover and the axis rod drive each other through the elastic member. The outer covers of the supply shaft assembly and the take-up shaft assembly are connectable to the two ends of a ribbon, respectively. The axis rods of the supply shaft assembly and the take-up shaft assembly are connected to the base body and the transmission system through unidirectional transmission elements, respectively, so that the ribbon can be stably and continuously rewound for a distance needed.

4 Claims, 6 Drawing Sheets

RIBBON REWINDING MECHANISM FOR PROVIDING STABLE RIBBON TENSION IN A PRINTER

CROSS-REFERENCE TO RELATED PATENT APPLICATION

This application claims the benefit of priority to Taiwan Patent Application No. 107201399, filed on Jan. 29, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the present disclosure described herein. All references cited and discussed in this specification are incorporated herein by reference in their entireties and to the same extent as if each reference was individually incorporated by reference.

FIELD OF THE PRESENT DISCLOSURE

The present disclosure relates to a ribbon rewinding mechanism for providing stable ribbon tension, and more particularly to a ribbon rewinding mechanism for providing stable ribbon tension that is provided with a plurality of unidirectional elements and disposed in a printer.

BACKGROUND OF THE PRESENT DISCLOSURE

A conventional label printer has torsion springs (or friction members such as pieces of wool felt) arranged at its ribbon supply shaft and ribbon take-up shaft, so as to maintain ribbon tension during a printing process, and rewind a carbon ribbon for a short distance through the elastic force of the torsion springs after a printed label is torn off. In this way, before the printer prints the next label, a portion that is left protruding out of the printer after the previous printing process can be rewound to facilitate a subsequent printing process.

However, the conventional torsion-spring-aided ribbon rewinding design for a label printer only allows the carbon ribbon to be rewound for a short distance. In applications requiring printing of longer distances, the carbon ribbon cannot be rewound completely. As a solution, driving the ribbon supply shaft and the ribbon take-up shaft respectively by a direct current (DC) motor to rewind the carbon ribbon has been proposed. However, such a solution not only involves a more complicated overall mechanism and incurs higher costs, but is prone to cause the carbon ribbon to be too loose or too tight if there is an improper rotational speed design or a change in motor characteristics after being used for a long time.

A loose carbon ribbon may cause ribbon wrinkling during a printing process, and therefore affect printing quality; and a carbon ribbon that is too tight is prone to break.

As the technical solution of driving the ribbon supply shaft and the ribbon take-up shaft respectively by a DC motor to rewind a belt body not only incurs higher costs and difficulties in adjusting for ideal working conditions, but also has less-than-desired stability, there is still room for improvement in belt body rewinding techniques.

SUMMARY OF THE PRESENT DISCLOSURE

In response to the above-referenced technical inadequacies, the present disclosure provides a ribbon rewinding mechanism for providing stable ribbon tension in a printer, which serves as a low cost solution having high operational stability.

In one aspect, the present disclosure is directed to a ribbon rewinding mechanism for providing stable ribbon tension in a printer, which includes a base body, a supply shaft assembly, a take-up shaft assembly, a driving unit and a transmission system. The base body is disposed on the printer. The supply shaft assembly includes a first axis rod, at least one supply outer cover and at least one first elastic member. The first axis rod is connected to the base body through a first unidirectional transmission element. The at least one supply outer cover is connectable to a first end of a ribbon. The supply outer cover and the first axis rod drive each other through the first elastic member. The take-up shaft assembly includes a second axis rod, at least one take-up outer cover and at least one second elastic member. The second axis rod is connected to the base body through a second unidirectional transmission element. The at least one take-up outer cover is connectable to a second end of the ribbon. The take-up outer cover and the second axis rod drive each other through the second elastic member. The transmission system is connected to the driving unit, connected to the first axis rod through a third unidirectional transmission element, and connected to the second axis rod through a fourth unidirectional transmission element. When the driving unit drives the transmission system to rotate in a supplying direction, the fourth unidirectional transmission element drives the take-up shaft assembly to rotate, the take-up shaft assembly drives the supply outer cover to rotate through the ribbon, and the first axis rod is restricted by the first unidirectional transmission element from causing the rotation of the supply outer cover. When the driving unit drives the transmission system to rotate in a rewinding direction, the third unidirectional transmission element drives the supply shaft assembly to rotate, the supply shaft assembly drives the take-up outer cover to rotate through the ribbon, and the second axis rod is restricted by the second unidirectional transmission element from causing the rotation of the take-up outer cover.

In another aspect, the present disclosure is directed to a ribbon rewinding mechanism for providing stable ribbon tension, which includes a base body, a supply shaft assembly, a take-up shaft assembly, a driving unit and a transmission system. The supply shaft assembly includes a first axis rod, at least one supply outer cover and at least one first elastic member. The first axis rod is connected to the base body through a first unidirectional transmission element. The at least one supply outer cover is connectable to a first end of a ribbon. The supply outer cover and the first axis rod drive each other through the first elastic member. The take-up shaft assembly includes a second axis rod, at least one take-up outer cover and at least one second elastic member. The second axis rod is connected to the base body through a second unidirectional transmission element. The at least one take-up outer cover is connectable to a second end of the ribbon. The take-up outer cover and the second axis rod drive each other through the second elastic member. The transmission system is connected to the driving unit, connected to the first axis rod through a third unidirectional transmission element, and connected to the second axis rod through a fourth unidirectional transmission element. When the driving unit drives the transmission system to rotate in a supplying direction, the fourth unidirectional transmission element drives the take-up shaft assembly to rotate, the take-up shaft assembly drives the supply outer cover to rotate through the ribbon, and the first axis rod is restricted by the first unidirectional transmission element from causing the rotation of the supply outer cover. When the driving unit drives the transmission system to rotate in a rewinding direction, the third unidirectional transmission element drives the supply shaft assembly to rotate, the supply shaft assembly drives the take-up outer cover to rotate through the ribbon, and the second axis rod is restricted by the second unidirectional transmission element from causing the rotation of the take-up outer cover.

Therefore, through the technical feature of "the first unidirectional transmission element," "the second unidirectional transmission element," "the third unidirectional transmission element" and "the fourth unidirectional transmission element" cooperating with each other, the ribbon rewinding mechanism for providing stable ribbon tension in a printer can stably provide the carbon ribbon with proper tension during the supplying (printing) process and the rewinding (especially for longer distances) process, and during the rewinding process, the carbon ribbon B can be continuously rewound for a distance needed.

These and other aspects of the present disclosure will become apparent from the following description of certain embodiments taken in conjunction with the following drawings and their captions, although variations and modifications therein may be affected without departing from the spirit and scope of the novel concepts of the present disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
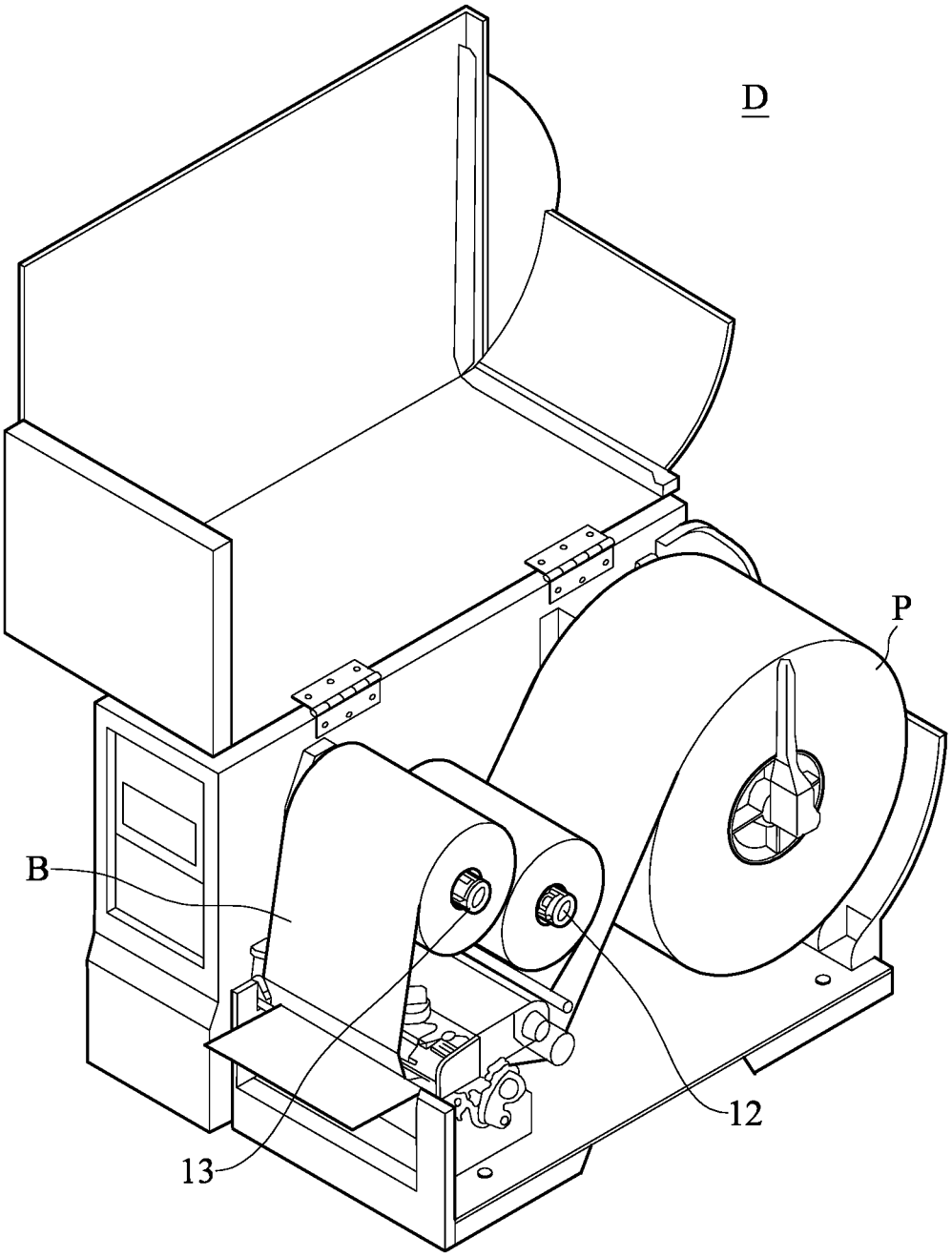
FIG. 1 is a structural view of a printer according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
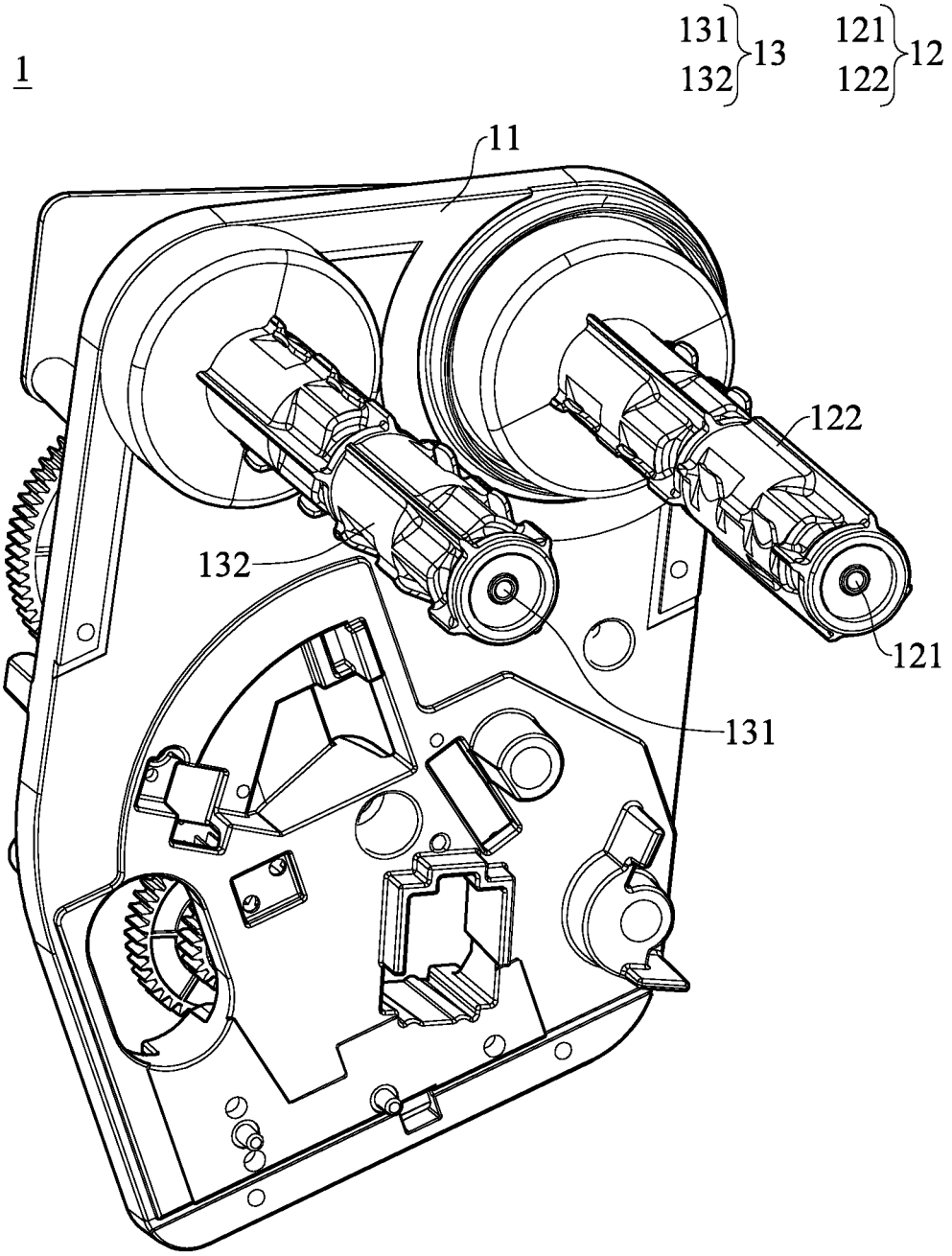
FIG. 2 is a perspective assembled view of a ribbon rewinding mechanism for providing stable ribbon tension according to the first embodiment of the present disclosure.
Figure 3:
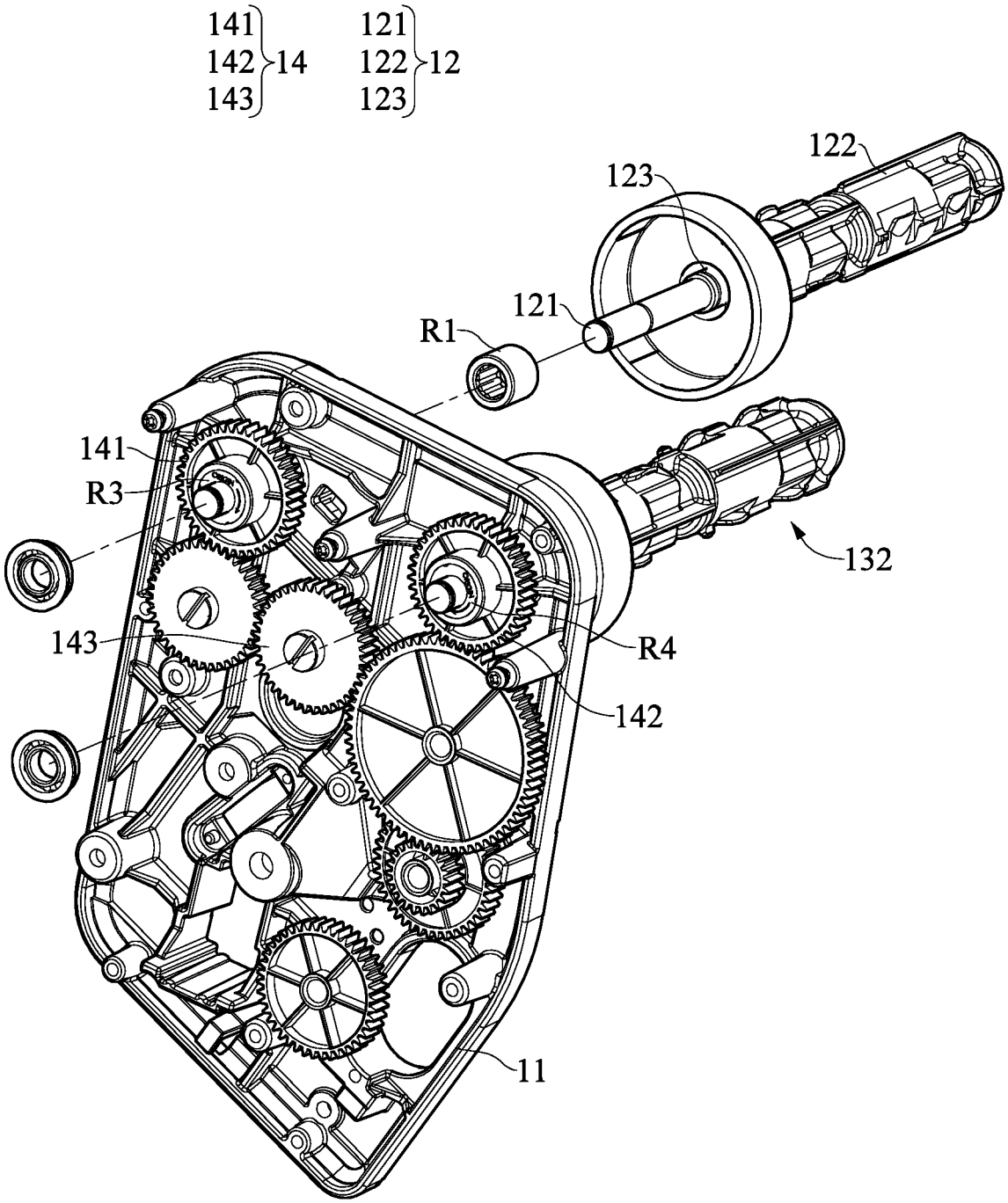
FIG. 3 is a perspective partially-exploded view of the ribbon rewinding mechanism for providing stable ribbon tension according to the first embodiment of the present disclosure.

Reference is made to FIG. 1 and FIG. 2. FIG. 1 is a structural view of a printer D according to the first embodiment of the present disclosure. FIG. 2 is a perspective assembled view of a ribbon rewinding mechanism 1 for providing stable ribbon tension in a printer according to the first embodiment of the present disclosure. As can be seen from FIG. 1 and FIG. 2, the ribbon rewinding mechanism 1 for providing stable ribbon tension in the printer D according to the first embodiment of the present disclosure includes a base body 11, a supply shaft assembly 12, a take-up shaft assembly 13, a driving unit (not shown in the figures), and a transmission system 14 (as shown in FIG. 3). It should be noted in advance that descriptions relating to the terms "supply" and "take-up" in the present disclosure are mainly based on the roles of the ribbon rewinding mechanism 1 serving in a normal working state (namely, a printing state) of the printer D, in which the shaft assembly used to provide unused carbon ribbon B is referred to as the supply shaft assembly 12, and the shaft assembly used to take up the used carbon ribbon B is referred to as the take-up shaft assembly 13, so as to distinguish between the two shaft assemblies and facilitate understanding of the technique of the present disclosure. However, which one of the two shaft assemblies actively drives the scrolling of the carbon ribbon B during the process of printing or the process of retracting the carbon ribbon B is not limited by the foregoing description, and the roles and/or positions of the two shaft assemblies can be exchanged.

Further, the supply shaft assembly 12 and the take-up shaft assembly 13 are disposed on the printer D through the base body 11. The base body 11 can be a mounting plate detachably disposed on the printer D, or may be a part of the printer D itself. In the present embodiment, a carbon ribbon B is a ribbon (in the present embodiment, a carbon ribbon) used for printing a label, and the two ends of the carbon ribbon B are respectively connected to the supply shaft assembly 12 and the take-up shaft assembly 13. As the supply shaft assembly 12 or the take-up shaft assembly 13 rotates, the content desired by a user is printed onto the paper strip P.

Figure 4:
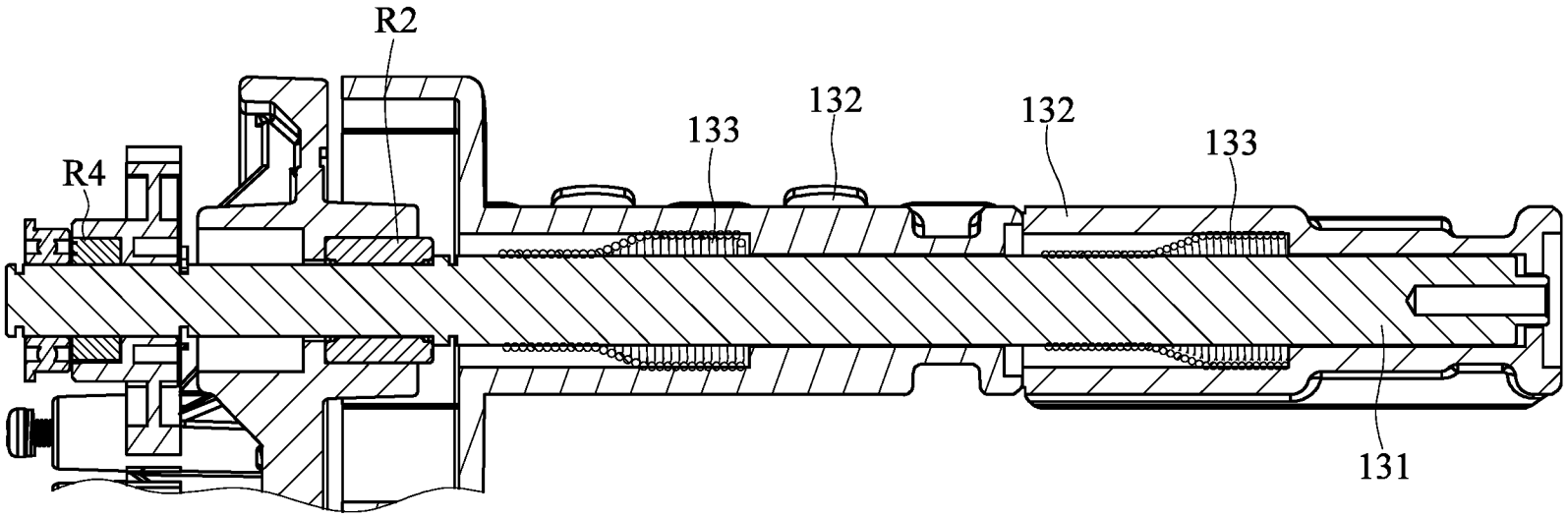
FIG. 4 is a cross-sectional view of a take-up shaft assembly of the ribbon rewinding mechanism for providing stable ribbon tension according to the first embodiment of the present disclosure.

Next, the specific structure of the supply shaft assembly 12 and the take-up shaft assembly 13 and their connection relationship with the base body 11 is further described as follows. Reference is made to FIG. 3 and FIG. 4. FIG. 3 is a perspective partially-exploded view of the ribbon rewinding mechanism 1 for providing stable ribbon tension according to the first embodiment of the present disclosure. FIG. 4 is a cross-sectional view of the take-up shaft assembly 13 of the first embodiment. The supply shaft assembly 12 includes a first axis rod 121, at least one supply outer cover 122 and at least one first elastic member 123. The first axis rod 121 is connected to the base body 11 through a first unidirectional transmission element R1. The supply outer cover 122 is sleeved on the first axis rod 121, and the supply outer cover 122 and the first axis rod 121 drive each other through the first elastic member 123. Similarly, the take-up shaft assembly 13 includes a second axis rod 131, at least one take-up outer cover 132 and at least one second elastic member 133. The second axis rod 131 is connected to the base body 11 through the second unidirectional transmission element R2. The take-up outer cover 132 is sleeved on the second axis rod 131, and the take-up outer cover 132 and the second axis rod 131 drive each other through the second elastic member 133.

Specifically, the first elastic member 123 and the second elastic member 133 of the present embodiment can be elastic torsion springs. Taking the supply shaft assembly 12 as an example, when the first axis rod 121 rotates, the friction between the first axis rod 121 and the first elastic member 123 and between the first elastic member 123 and the supply outer cover 122 causes the supply outer cover 122 and the first axial rod 121 to drive each other, and causes the first elastic member 123 to be elastically deformed and cumulates elastic potential energy in the first elastic member 123. Through the cumulated elastic potential energy in the first elastic member 123, the tension on the carbon ribbon B (as shown in FIG. 1) can be maintained. It should be particularly noted that although elastic torsion springs are used as the first elastic member 123 and the second elastic member 133 in the present embodiment, in actual practice, friction members (or called slipping members) having similar functions, such as those made of wool felt, may be used instead, and the present disclosure is not limited to the materials named in the embodiments of the present disclosure.

Further, referring to FIG. 1 and FIG. 4, taking the supply shaft assembly 12 again as an example, in the present embodiment, the supply shaft assembly 12 can further include a second supply outer cover 122 and another first elastic member 123. The second supply cover 122 and the first axis rod 121 drive each other through the other first elastic member 123. In other words, the supply shaft assembly 12 of the present embodiment can be provided with two sets of supply outer covers 122 and first elastic members 123. In actual practice, if the carbon ribbon B to be used has a relatively small width, or cannot withstand a relatively large tension, the carbon ribbon B can be sleeved on only one set of supply outer cover 122 to prevent the carbon ribbon B from breaking when the elastic restoring force of two sets of first elastic members 123 is overly large. By contrast, if a relatively large elastic restoring force is needed to maintain the tension on the carbon ribbon B, the carbon ribbon B can be sleeved on both of the two supply outer covers 122, thereby obtaining a sufficient elastic restoring force from the first elastic members 123. In actual practice, the number of the supply outer cover 122 and the first elastic member 123 may be appropriately adjusted as needed, and is not limited to one or two as described in the present embodiment. On the other hand, the take-up shaft assembly 13 of the present disclosure can also have a similar design to cooperatively adjust the tension on the carbon ribbon B, and the specific principles and technical details thereof are not repeated herein for brevity.

Figure 5:
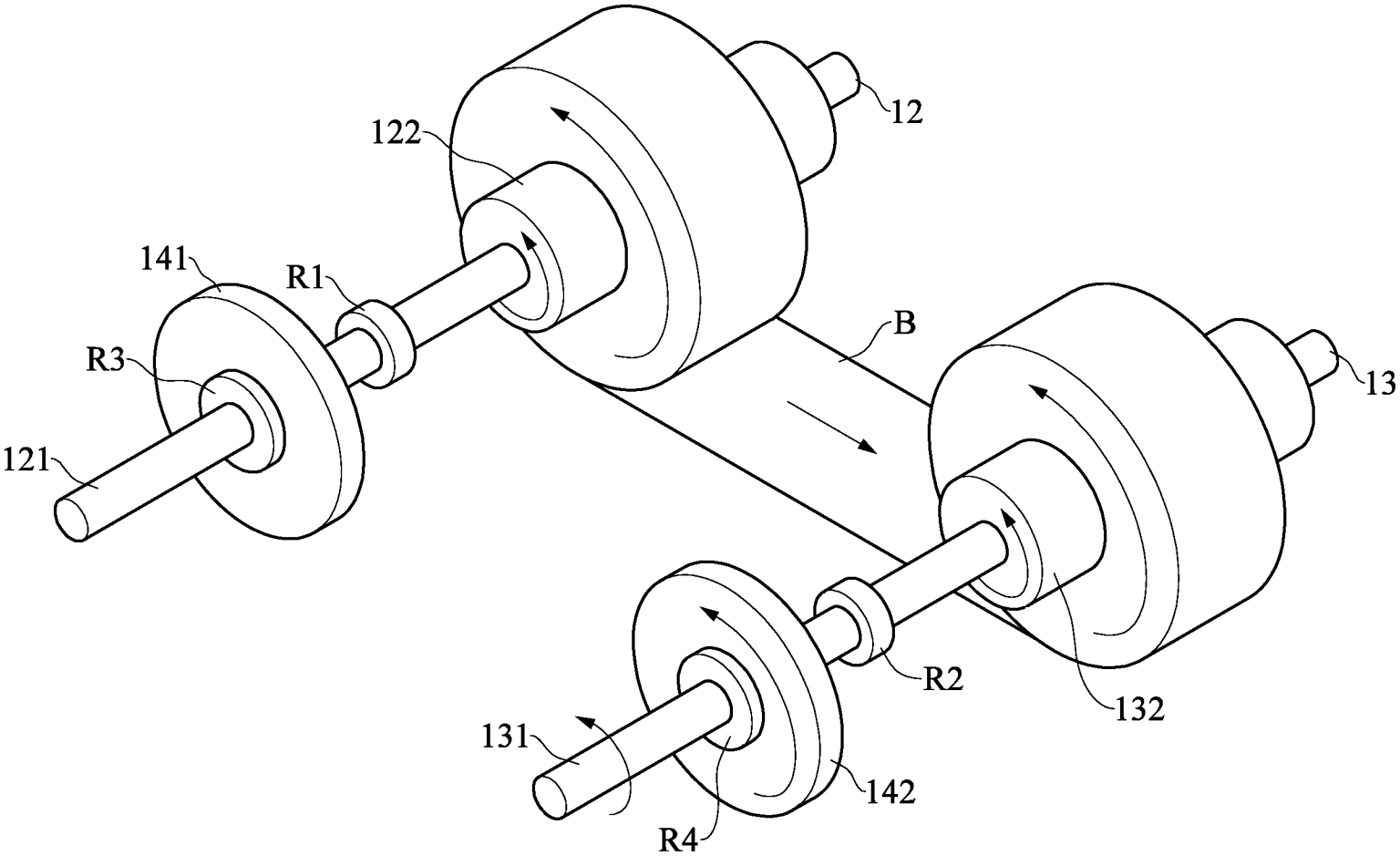
FIG. 5 is a schematic diagram of the rotation relationship between a supply shaft assembly and the take-up shaft assembly when the two shaft assemblies rotate in a supplying direction to pull a ribbon from the side of the supply shaft assembly to the side of the take-up shaft assembly according to the first embodiment of the present disclosure.
Figure 6:
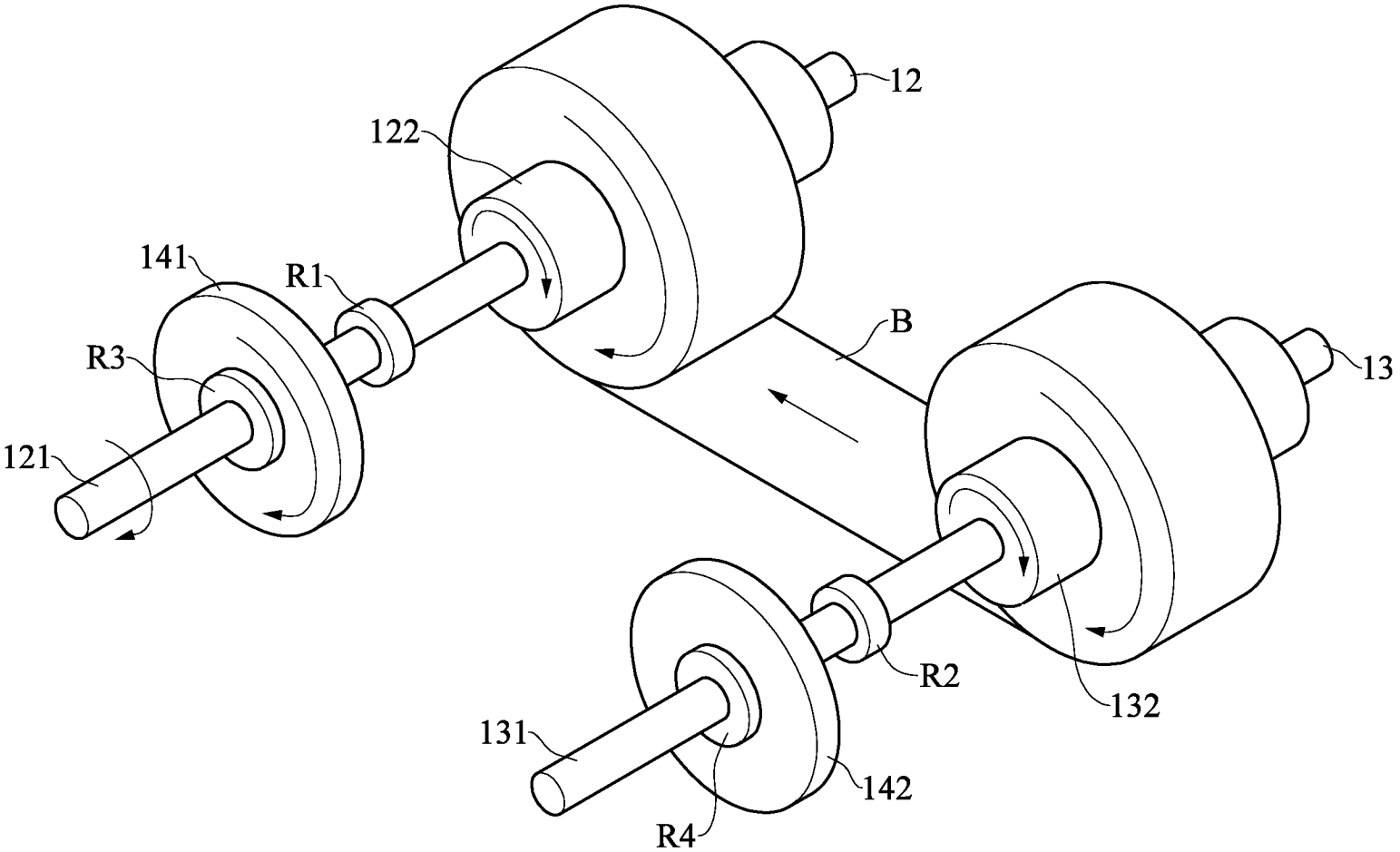
FIG. 6 is a schematic diagram of the rotation relationship between the supply shaft assembly and the take-up shaft assembly when the two shaft assemblies rotate in a rewinding direction to pull the ribbon from the side of the take-up shaft assembly to the side of the supply shaft assembly according to the first embodiment of the present disclosure.

Referring to FIG. 3, together with FIGS. 5 and 6, the working states of the ribbon rewinding mechanism 1 for providing stable ribbon tension of the present disclosure is described as follows. FIG. 5 is a schematic diagram of the rotation relationship between the supply shaft assembly 12 and the take-up shaft assembly 13 when the two shaft assemblies 12 and 13 rotate in a supplying direction to pull the carbon ribbon B from the side of the supply shaft assembly 12 to the take-up shaft assembly 13. FIG. 6 is a schematic diagram of the rotation relationship between the supply shaft assembly 12 and the take-up shaft assembly 13 when the two shaft assemblies 12 and 13 rotate in a rewinding direction to pull the carbon ribbon B from the side of the take-up shaft assembly 13 to the side of the supply shaft assembly 12. As can be seen from the above figures, the two ends of the carbon ribbon B of the present disclosure are respectively connected to the supply outer cover 122 and the take-up outer cover 132. The transmission system 14 of the present disclosure is connected to the driving unit (not shown in the figures) to drive the first axis rod 121 or the second axis rod 131 to rotate by the driving force generated by the driving unit. The drive unit can be a DC motor or any other component that can provide a source of power.

Specifically, the transmission system 14 is connected to the first axis rod 121 through a third unidirectional transmission element R3, and connected to the second axis rod 131 through a fourth unidirectional transmission element R4. Accordingly, the transmission system 14 can drive the first axis rod 121 through the third unidirectional transmission element R3, and can also drive the second axis rod 131 through the fourth unidirectional transmission element R4. In the present embodiment, the transmission system 14 further includes a supply gear 141, a take-up gear 142, and a transmission gear set 143. The supply gear 141 is connected to the third unidirectional transmission element R3 to drive the first axis rod 121 through the third unidirectional transmission element R3. The take-up gear 142 is connected to the fourth unidirectional transmission element R4 to drive the second axis rod 131 through the fourth transmission element R4. The transmission gear set 143 is meshed with the supply gear 141 and the take-up gear 142, respectively, such that the supply gear 141 and the take-up gear 142 rotate together. In the present embodiment, the transmission gear set 143 has three intermeshing gears, but the present disclosure is not limited thereto. Specifically, as long as a structure can drive the supply gear 141 and the take-up gear 142 to rotate with each other, such a structure can be defined as the transmission gear set 143.

Referring to FIG. 5, during a printing process, the driving unit drives the transmission system 14 (as shown in FIG. 3) to rotate in the supplying direction to pull the carbon ribbon B from the side of the supply shaft assembly 12 to the side of the take-up shaft assembly 13. At this time, the fourth unidirectional transmission element R4 is in a transmission state, and the second unidirectional transmission element R2 is in an idle state, so that the transmission system 14 can drive the second axis rod 131 of the take-up shaft assembly 13 to rotate through the fourth unidirectional transmission element R4, while the rotation of the second axis rod 131 is not restricted by the second unidirectional transmission element R2. The rotation of the second axis rod 131 causes the take-up outer cover 132 to rotate together with the second axis rod 131, so the take-up shaft assembly 13 can drive the carbon ribbon B through the take-up outer cover 132, and further drive the supply outer cover 122 through the carbon ribbon B.

In this state, since the rotation of the first axis rod 121 is restricted by the first unidirectional transmission element R1, although the supply outer cover 122 is driven by the carbon ribbon B, the supply outer cover 122 cannot drive the first axis rod 121 through the first elastic member 123. Specifically, since the rotation of the first axis rod 121 is restricted by the first unidirectional transmission element R1, friction continuously acts on the first elastic member 123, and the elastic potential energy is cumulated in the first elastic member 123, until the cumulated elastic potential energy is greater than the maximum static friction between the first elastic member 123 and the first axis rod 121 or the supply outer cover 122. When the cumulated elastic potential energy is greater than the maximum static friction between the first elastic member 123 and the first axis rod 121 or the supply outer cover 122, the first elastic member 123 rotates relative to the first axis rod 121 or the supply outer cover 122. When the external force applied to the first elastic member 123 is gone (for example, when printing is completed), the elastic restoring force of the first elastic member 123 is exerted on the first axis rod 121 and the supply outer cover 122, thereby driving the supply outer cover 122 to rotate in the opposite direction to rewind the carbon ribbon B for a small distance. It should be particularly noted that since the amount of the cumulated elastic potential energy is limited, the short-distance rewinding mechanism discussed above cannot rewind the carbon ribbon B for a longer distance continuously.

Referring to FIG. 6, the operation details of the ribbon rewinding mechanism 1 rewinding the carbon ribbon B is described as follows. During the process of rewinding the carbon ribbon B for a longer distance, the driving unit drives the transmission system 14 (shown in FIG. 3) to rotate in the rewinding direction to pull the carbon ribbon B from the side of the take-up shaft assembly 13 to the side of the supply shaft assembly 12. At this time, the third unidirectional transmission element R3 is in a transmission state, and the first unidirectional transmission element R1 is in an idle state, so that the transmission system 14 can drive the first axis rod 121 of the supply shaft assembly 12 to rotate through the third unidirectional transmission element R3, and the rotation of the first axis rod 121 is not restricted by the first unidirectional transmission element R1. In this way, as long as the driving unit continuously drives the transmission system 14 to rotate in the rewinding direction, the supply shaft assembly 12 can continuously rewind the carbon ribbon B, and the rewinding distance is not limited by the elastic potential energy cumulated in the first elastic member 123 or the second elastic member 133.

In the foregoing process of rewinding the carbon ribbon B, the supply shaft assembly 12 drives the take-up outer cover 132 through the carbon ribbon B. Similarly, since the rotation of the second axis rod 131 is restricted by the second unidirectional transmission element R2, although the take-up outer cover 132 is driven by the carbon ribbon B, the take-up outer cover 132 cannot drive the second axis rod 131 through the second elastic member 133.

Reference is made again to FIGS. 3, 5 and 6. It is worth mentioning that although the second axis rod 131 of the take-up shaft assembly 13 is driven by the take-up gear 142 through the fourth unidirectional transmission element R4, during a printing process, since the third unidirectional transmission element R3 is in an idle state, the supply gear 141 does not drive the first axis rod 121 to rotate (and at this time, the first axis rod 121 is restricted by the first unidirectional transmission element R1, and therefore does not rotate relative to the base body 11) when rotating together with the take-up gear 142.

By contrast, during the process of rewinding the carbon ribbon B, although the supply gear 141 drives the first axis rod 121 of the supply shaft assembly 12 to rotate through the third unidirectional transmission element R3, since the fourth unidirectional transmission element R4 is in an idle state, the take-up gear 142 does not drive the second axis rod 131 to rotate (and at this time, the second axis rod 131 is restricted by the second unidirectional transmission element R2, and therefore does not rotate relative to the base body 11) when rotating together with the supply gear 141.

The afore-referenced design has at least the following advantages. Through the first unidirectional transmission element R1, the second unidirectional transmission element R2, the third unidirectional transmission element R3 and the fourth unidirectional transmission element R4 that are in cooperation with the first elastic member 123 and the second elastic member 133, a constant tension can be exerted on the carbon ribbon B regardless of whether the first axial rod 121 rotates together with the second axial rod 131, or whether the first axial rod 121 and the second axial rod 131 are respectively driven by a motor, and the outermost ribbon layers wound respectively thereon have different rotational speeds. Accordingly, problems such as loosening or breaking of the carbon ribbon B can be avoided.

Also, in the present embodiment, the first unidirectional transmission element R1, the second unidirectional transmission element R2, the third unidirectional transmission element R3, and the fourth unidirectional transmission element R4 can be unidirectional bearings, while in other embodiments of the present disclosure, the unidirectional transmission elements are not limited to being unidirectional bearings. Specifically, as long as a component is capable of having a transmission state and an idle state, and achieving a unidirectional transmission purpose, the component can be used as the first unidirectional transmission element R1, the second unidirectional transmission element R2, the third unidirectional transmission element R3, or the fourth unidirectional transmission element R4 of the present disclosure.

Second Embodiment

Referring again to FIG. 3, it is noted that while in the first embodiment of the present disclosure the transmission system 14 includes components such as a supply gear 141, a take-up gear 142 and a transmission gear set 143, in other embodiments, the transmission system 14 can include a supply pulley, a take-up pulley, a transmission belt, and the like. In the second embodiment, the supply pulley is connected to the third unidirectional transmission element R3, the take-up pulley is connected to the fourth unidirectional transmission element R4, and the supply pulley and the take-up pulley are mutually connected by the transmission belt. Such an arrangement can also achieve the purpose served by the transmission system 14 of the present disclosure, and therefore also falls within the scope covered by the transmission system 14 of the present disclosure. Similarly, other transmission methods sufficient to achieve the same or similar transmission effects are also within the scope of the transmission system 14 of the present disclosure.

Therefore, through the technical feature of "the first unidirectional transmission element R1," "the second unidirectional transmission element R2," "the third unidirectional transmission element R3" and "the fourth unidirectional transmission element R4" cooperating with each other, the ribbon rewinding mechanism 1 for providing stable ribbon tension of the present disclosure can stably provide the carbon ribbon B with proper tension during the supplying (printing) process and the rewinding (especially for longer distances) process, and during the rewinding process, the carbon ribbon B can be continuously rewound for a distance needed.

Further, through a simpler structural design, the present disclosure achieves an excellent effect of stably providing proper tension at a very low cost, which helps to greatly enhance the competitive advantage of a product. Although the present disclosure mainly uses the printer D to exemplarily describe the mechanism for pulling a ribbon (such as the carbon ribbon B for printing) in two opposite directions for a long distance, but in other embodiments, the mechanism can also be applied to other devices that require a belt body to be pulled.

The foregoing description of the exemplary embodiments of the present disclosure has been presented only for the purposes of illustration and description and is not intended to be exhaustive or to limit the present disclosure to the precise forms disclosed. Many modifications and variations are possible in light of the above teaching.

Certain embodiments were chosen and described in order to explain the principles of the present disclosure and their practical application so as to enable others skilled in the art to utilize the present disclosure and various embodiments and with various modifications as are suited to the particular use contemplated. Alternative embodiments will become apparent to those skilled in the art to which the present disclosure pertains without departing from its spirit and scope.

What is claimed is:

1. A ribbon rewinding mechanism for a printer, comprising:

a base body disposed on the printer;

a supply shaft assembly, comprising:

a first axis rod connected to the base body through a first unidirectional transmission element;

at least one first elastic member; and at least one supply outer cover connectable to a first end of a ribbon, wherein the supply outer cover and the first axis rod drive each other through the first elastic member;

a take-up shaft assembly, comprising:

a second axis rod connected to the base body through a second unidirectional transmission element;

at least one second elastic member; and at least one take-up outer cover connectable to a second end of the ribbon, wherein the take-up outer cover and the second axis rod drive each other through the second elastic member; and a transmission system connected to the first axis rod through a third unidirectional transmission element and the second axis rod through a fourth unidirectional transmission element, wherein when the transmission system is driven to rotate in a supplying direction, the fourth unidirectional transmission element drives the take-up shaft assembly to rotate, the take-up shaft assembly drives the supply outer cover to rotate through the ribbon, and the first axis rod is restricted by the first unidirectional transmission element from causing the rotation of the supply outer cover;

wherein when the transmission system is driven to rotate in a rewinding direction, the third unidirectional transmission element drives the supply shaft assembly to rotate, the supply shaft assembly drives the take-up outer cover to rotate through the ribbon, and the second axis rod is restricted by the second unidirectional transmission element from causing the rotation of the take-up outer cover; and wherein the transmission system further comprises:

a supply gear connected to the third unidirectional transmission element;

a take-up gear connected to the fourth unidirectional transmission element; and a transmission gear set intermeshed with the supply gear and the take-up gear.

2. The ribbon rewinding mechanism for the printer according to claim 1, wherein the first unidirectional transmission element, the second unidirectional transmission element, the third unidirectional transmission element, and the fourth unidirectional transmission element are unidirectional bearings.

3. A ribbon rewinding mechanism, comprising:

a base body;

a supply shaft assembly, comprising:

a first axis rod connected to the base body through a first unidirectional transmission element;

at least one first elastic member; and at least one supply outer cover connectable to a first end of a ribbon, wherein the supply outer cover and the first axis rod drive each other through the first elastic member;

a take-up shaft assembly, comprising:

a second axis rod connected to the base body through a second unidirectional transmission element;

at least one second elastic member; and at least one take-up outer cover connectable to a second end of the ribbon, wherein the take-up outer cover and the second axis rod drive each other through the second elastic member; and a transmission system connected to the first axis rod through a third unidirectional transmission element and the second axis rod through a fourth unidirectional transmission element, wherein when the transmission system is driven to rotate in a supplying direction, the fourth unidirectional transmission element drives the take-up shaft assembly to rotate, the take-up shaft assembly drives the supply outer cover to rotate through the ribbon, and the first axis rod is restricted by the first unidirectional transmission element from causing the rotation of the supply outer cover;

wherein when the transmission system is driven to rotate in a rewinding direction, the third unidirectional transmission element drives the supply shaft assembly to rotate, the supply shaft assembly drives the take-up outer cover to rotate through the ribbon, and the second axis rod is restricted by the second unidirectional transmission element from causing the rotation of the take-up outer cover; and wherein the transmission system further comprises:

a supply gear connected to the third unidirectional transmission element;

a take-up gear connected to the fourth unidirectional transmission element; and a transmission gear set intermeshed with the supply gear and the take-up gear.

4. The ribbon rewinding mechanism for the printer according to claim 3, wherein the first unidirectional transmission element, the second unidirectional transmission element, the third unidirectional transmission element, and the fourth unidirectional transmission element are unidirectional bearings.

* * * * *